US007815284B2

(12) United States Patent
Ito

(10) Patent No.: US 7,815,284 B2
(45) Date of Patent: Oct. 19, 2010

(54) LIQUID DROP EJECTION HEAD

(75) Inventor: Atsushi Ito, Nagoya (JP)

(73) Assignee: Brother Kogyo Kabushik Kaisha, Aichi-ken (JP)

( * ) Notice: Subject to any disclaimer, the term of this patent is extended or adjusted under 35 U.S.C. 154(b) by 419 days.

(21) Appl. No.: 12/011,893

(22) Filed: Jan. 30, 2008

(65) Prior Publication Data

US 2009/0002444 A1 Jan. 1, 2009

(30) Foreign Application Priority Data

Jan. 30, 2007 (JP) ..... 2007-019762

(51) Int. Cl.
*B41J 2/15* (2006.01)

(52) U.S. Cl. ..... 347/40; 347/65; 347/71

(58) Field of Classification Search ..... 347/40, 347/43, 64–65, 67, 68, 71
See application file for complete search history.

(56) References Cited

U.S. PATENT DOCUMENTS 6,554,409 B2 4/2003 Ishii
7,452,060 B2 * 11/2008 Nakamura et al. ..... 347/71
7,494,210 B2 * 2/2009 Yamada et al. ..... 347/71
7,520,596 B2 * 4/2009 Yasui ..... 347/71
2005/0253488 A1 11/2005 Ito

FOREIGN PATENT DOCUMENTS

JP 2001-219555 8/2001
JP 2005-322850 11/2005
JP 2006334797 12/2006

* cited by examiner

*Primary Examiner*—Lamson D Nguyen
(74) *Attorney, Agent, or Firm*—Frommer Lawrence & Huag LLP

(57) ABSTRACT

A liquid drop ejecting head includes a cavity section which is formed by laminating a plurality of plates including at least first and second manifold plates adjacent to each other in a laminating direction. Each of the first and second manifold plates includes an opening. The openings overlap with each other when viewed in the laminating direction. At least one of the openings includes: a first opening which extends in the first direction and serves as a common liquid chamber; a second opening which is adjacent to the first opening and serves as a supply path; and a partitioning portion disposed between the first opening and the second opening.

17 Claims, 9 Drawing Sheets

LIQUID DROP EJECTION HEAD

CROSS-REFERENCE TO RELATED APPLICATION

This application claims priority from Japanese Patent Application No. 2007-019762, filed on Jan. 30, 2007, the entire subject matter of which is incorporated herein by reference.

TECHNICAL FIELD

Aspects of the present invention relate a liquid drop ejecting head that includes a common liquid chamber storing liquid to distribute the liquid to a plurality of nozzles and that is formed by laminating a plurality of plates.

BACKGROUND

An inkjet-type recording head is known as a liquid drop ejecting head for ejecting liquid drops from a plurality of nozzles. In such a recording head, it is required to reduce the whole size, even when complicate ink flow paths are necessary for the inside thereof in order to distribute and eject ink supplied from an ink supply source to the nozzles. Therefore, for example, JP-A-2006-334797 describes a small recording head formed by laminating a plurality of thin plates, each formed with penetration portions and concave portions, to form complicate ink flow paths inside.

The laminated plates includes a plurality of plates such as a nozzle plate where plural nozzles are formed in a hole shape and are arranged in a linear shape as a whole, a manifold plate where a long hole (opening) for forming a common ink chamber (a manifold) is formed in a through-hole shape, and a cavity plate where a pressure chamber receiving an ejecting pressure from an actuator is formed. The ink supplied from an ink supply source flows from the common ink chamber to the pressure chamber and the nozzle through the ink flow path in each plate.

Since the common ink chamber serves as a part for storing ink, which is distributed to the plural nozzles (see FIG. 6 in JP-A-2006-334797), it is necessary to form the common ink chamber so as to have a length substantially equal to a length of a nozzle row and a large inner capacity. In JP-A-2006-334797, the common ink chamber is formed by laminating two manifold plates, each of which includes long penetrating holes having the same shape, and sandwiching the manifold plates with an upper plate formed as a ceiling face of the common ink chamber and a lower plate formed as a bottom face thereof.

In JP-A-2006-334797, five nozzle rows are arranged so as to correspond to inks having four colors of black, magenta, yellow, and cyan (two rows are used for only the black ink). Hence, five rows of the common ink chambers are also arranged so as to correspond to the five nozzle rows. Therefore, each of the manifold plates includes five long penetrating holes arranged in substantially parallel.

However, for responding to a recent demand for increasing accuracy and speed of recording, a recording head is required to have increased number of nozzles and to employ increased number of colors. Therefore, the number of nozzles or the number of nozzle rows tends to increase. When the number of nozzle rows increases, the number of common ink chambers corresponding thereto also increases, and thus the number of long penetrating holes formed in the manifold plates also increases. In other words, cut-out portions (void portions) penetrating through the manifold plates increases.

However, it is difficult to increase a size of the manifold plates in order to avoid an increase in size of a recording head including the manifold plates. Thus, the frame portions remaining in the manifold plate have to be decreased according to an increase in number of the common ink chambers. Particularly, between the long holes for the common ink chambers adjacent to each other, a frame portion remains, which has a narrow width and elongates along the common ink chambers (the long holes) so as to have a length equal to that of the common ink chamber. For example, since the recording head described in JP-A-2006-334797 has five common ink chambers, five long penetrating holes are formed at the center portion of the manifold plate. Thus, only long four frame portions remain, which have a narrow width formed between the five long holes and elongate in substantially parallel to each other. Therefore, rigidity of the entire manifold plates remarkably deteriorates. Additionally, at the time of dealing with the manifold plates, the frame portions having a narrow width could bend downwardly.

For plates includes a frame portion having small area as described above, operability (handling ability) is poor in various processes such as parts inspection, parts packing, and assembly, and thus there has been a problem that it is easy to cause deformation and damage in the plates.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid drop ejecting device including a common liquid chamber for storing liquid, which is distributed to a plurality of nozzles and can improve workability in plate handling by suppressing a decrease in rigidity of plates which forms the common liquid chamber.

The above and other aspects of the present invention are accomplished by providing a liquid drop ejecting head including a cavity section. The cavity section includes: a plurality of nozzles which are arranged in a row extending in a first direction and eject liquid drops; a common liquid chamber which distributes liquid to the nozzles; and a supply path which communicates with the common liquid chamber and supplies liquid from a liquid supply source to the common liquid chamber. The cavity section is formed by laminating a plurality of plates including at least first and second manifold plates adjacent to each other in a laminating direction. Each of the first and second manifold plates includes an opening. The openings of the first and second manifold plates overlap with each other when viewed in the laminating direction. At least one of the first and second manifold plates includes: a first opening which extends in the first direction and serves as the common liquid chamber; a second opening which is adjacent to the first opening and serves as the supply path; and a partitioning portion disposed between the first opening and the second opening.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

First Exemplary Embodiment

Hereinafter, exemplary embodiments of the present invention will be described with reference to drawings. A liquid drop ejecting head according to a first exemplary embodiment of the present invention is employed in a recording apparatus 1 which ejects ink to recording medium. The recording apparatus 1 may be employed as a single printer device or as a printer function part (a recording section) in a multi-function device having a plurality of functions of a facsimile, a copier, and the like.

Figure 1:
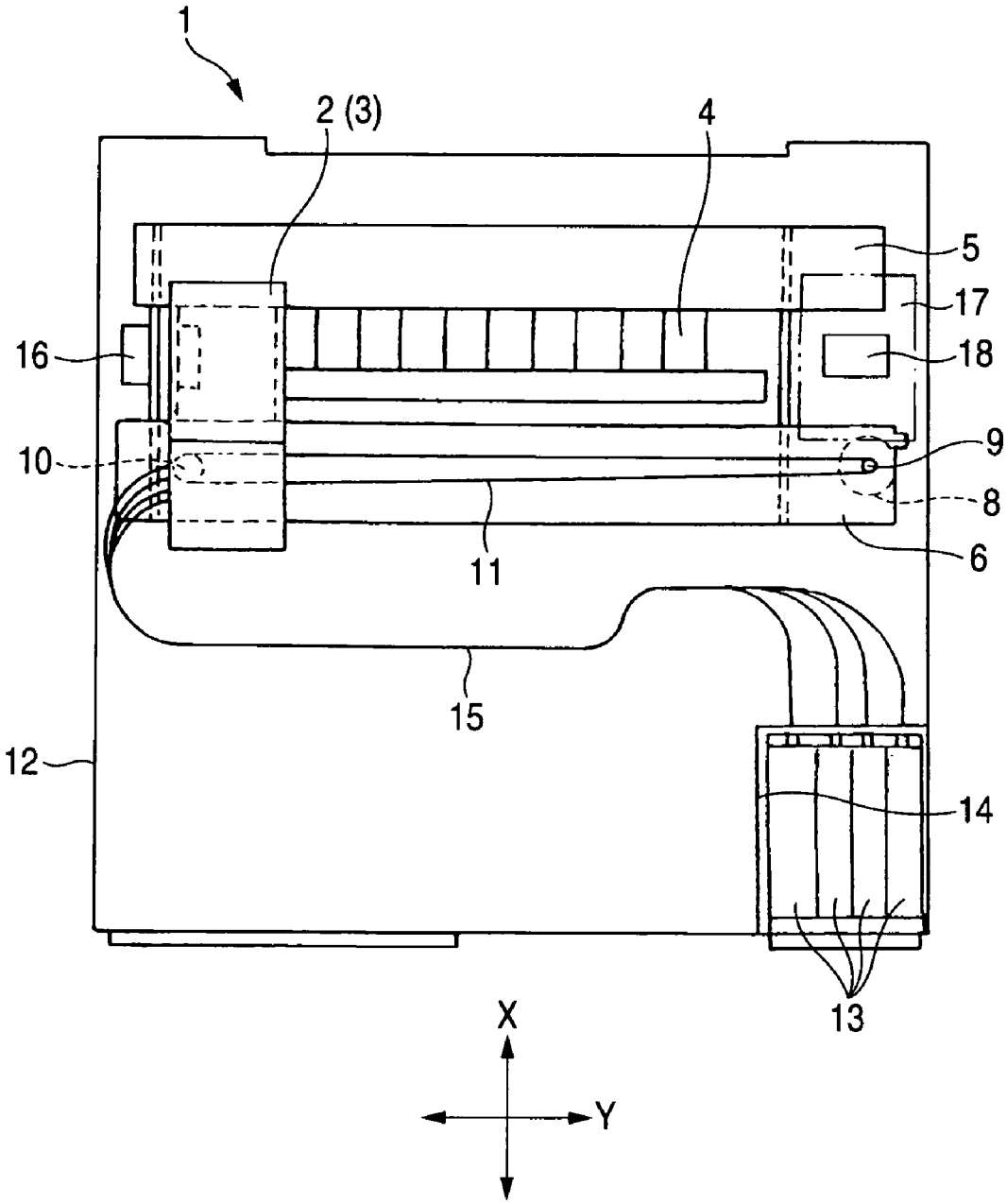
FIG. 1 is a top plan view illustrating a recording unit employing a recording head according to a first exemplary embodiment.

As shown in FIG. 1, the recording apparatus 1 includes a recording head 3 having nozzles 7 and mounted on a carriage 2, a platen 4 facing to a lower face of the recording head 3, a first guide member 5 and a second guide member 6 extending in a main-scanning direction (Y axis direction) of the carriage 2. The carriage 2 reciprocates along the guide members 5, 6. The recording head 3 is mounted on the carriage 2 so that the nozzles 7 (see FIGS. 3 to 5) are exposed as seen from the lower face thereof. In the following description, an opening side face of the nozzles of the recording head 3 is denoted as front face or a lower face (a lower side), and the other side face is denoted as a rear face or an upper face (an upper side).

A sheet serving as a recording medium is conveyed in a sub-scanning direction (X axis direction) orthogonal to the main-scanning direction (the Y axis direction) of the carriage 2. The carriage 2 is reciprocated in the Y axis direction by a timing belt 11 extending over a driving pulley 9 and a driven pulley 10 coupled to a carriage (CR) motor 8.

As shown in FIG. 1, the recording apparatus 1 further includes a body frame 12, a container 14 for replaceable ink cartridges 13, which is disposed in the body frame 12, and contains the ink cartridges 13 as many as the number of ink colors (herein, four color inks: a black ink, a cyan ink, a magenta ink, and a yellow ink). The inks in the cartridges 13 are supplied to the recording head 3 through ink supplying tubes 15 (the tubes are made of resin) having flexibility, respectively.

Additionally, the recording apparatus 1 further includes a flushing station 16 disposed on one end side and a recovery unit 17 disposed the other end side in the movable range of the carriage 2 in the main-scanning direction. The flushing station 16 receives inks ejected from the nozzles 7 of the recording head 3 regardless of recording operation. By ejecting inks in the flushing station 16 regardless of the recording operation, bubbles and thickened ink in ink flow paths of the recording head 3 is discharged and nozzle clogging is prevented and dissolved, so that maintenance and recovery in ejecting function of the nozzles are performed.

The recovery unit 17 suctions ink from the nozzle 7 of the recording head 3 periodically or in response to a request. The recovery unit 17 performs so-called a suction purge operation in which a nozzle surface of the nozzles 7 is covered with a cap 18, bubbles and thickened ink in ink flow paths in the recording head 3 are discharged from an outlet (not shown in the drawings) disposed on the cap 18 by activating a pressurizing unit (not shown in the drawings) communicating with the outlet, and the ejecting function of the nozzles 7 is recovered. Additionally, at the time when the recording operation is not performed, dust attachment and dry of the nozzle 7 may be prevented by covering the nozzle surface with the cap 18.

Figure 2:
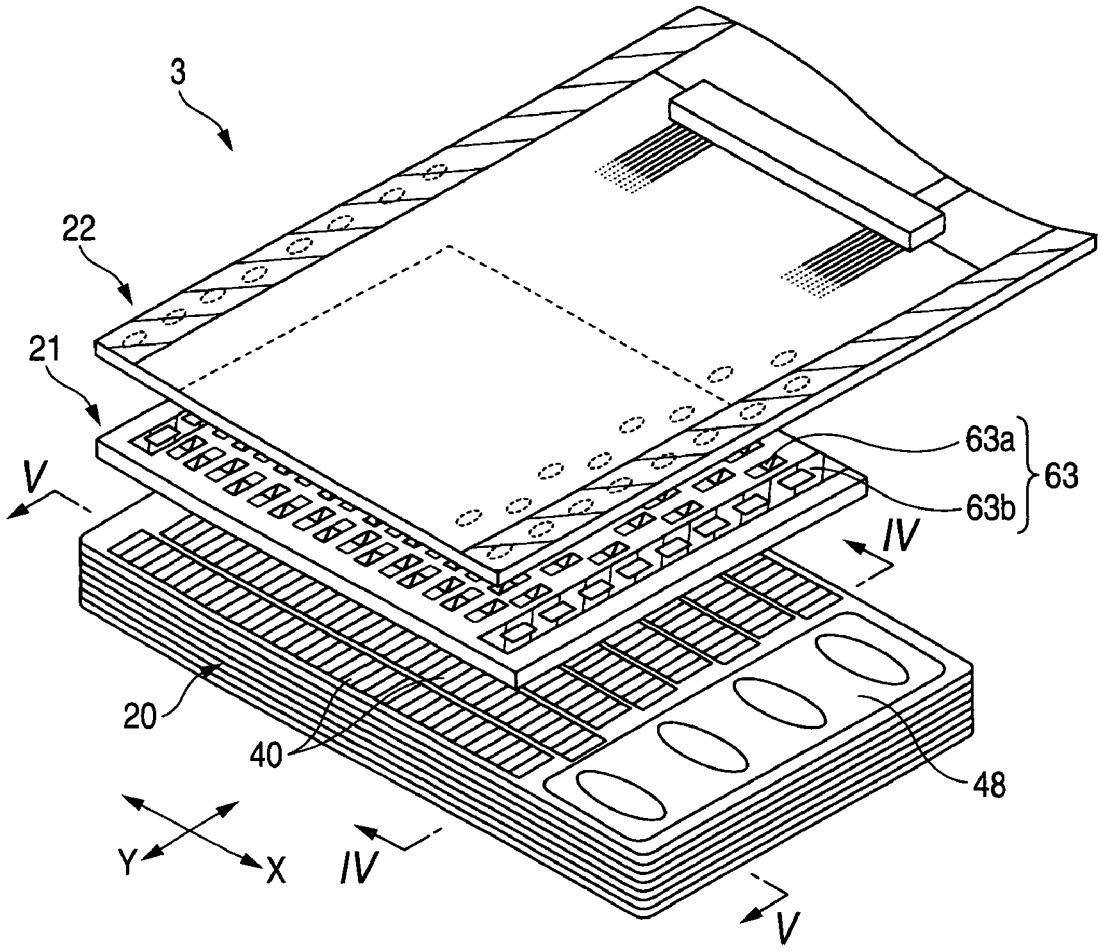
FIG. 2 is a perspective view illustrating the recording head according to the first exemplary embodiment.

FIG. 2 is a perspective view illustrating the recording head 3 including a cavity section 20, a piezoelectric actuator 21, and a flexible flat cable 22. The piezoelectric actuator 21 is joined to the cavity section 20 formed of plural plates, and the flexible flat cable 22 for connecting outer devices is electrically connected to the upper face of the actuator 21.

The ink flow paths provided in the cavity section 20 are formed so that the ink supplied from the ink cartridge 13 is collected in the common ink chambers 43 (manifold chambers or common liquid chambers) disposed in the cavity section 20. In addition, the ink flow paths are formed to connect the common ink chambers 43 to a plurality of pressure chambers 40 disposed on a position (a position of the upper face side) facing to the actuator 21 so as to distribute ink to the pressure chambers 40, and to connect the pressure chambers 40 to the nozzles 7 disposed on the lower face. When the ink in the pressure chambers 40 receives a predetermined ejecting pressure from the actuator 21, ink is ejected from the nozzle 7 and the ink is supplied from the common ink chamber 43 side to the pressure chamber 40. Detailed description will be given later.

In the same manner as described in JP-A-2005-322850, the actuator 21 includes a plurality of ceramic layers 60 formed in a planar shape having a size corresponding to the range of all pressure chambers 40 and laminated in a direction orthogonal to the planar direction, and a plurality of electrode layers disposed on the planar surface of the plurality of ceramic layers 60.

The electrode layers include driving electrode layers and a layer for the surface electrodes 63. The driving electrode layers include layers for individual electrodes 61 and layers for common electrodes 62 that are formed so as to face each other with the ceramic layer 60 interposed therebetween (see FIGS. 4 and 5). The layer for the surface electrodes 63 is disposed on an uppermost face of the electrode layers in order to be electrically connected to the flexible flat cable 22 (see FIGS. 2 and 3, the surface electrodes 63 is omitted in FIGS. 4 and 5). The individual electrodes 61 are formed for every pressure chamber 40, and the common electrodes 62 are formed in the range of the plurality of pressure chambers 40. The surface electrodes 63 include individual surface electrodes 63*a* electrically connected to the individual electrode 61 via through-holes and the like, and common surface electrodes 63*b* electrically connected to the common electrode 62 via through-holes and the like.

In the actuator 21 including the electrode layers as described above, a high voltage is applied between the individual electrode 61 and the common electrode 62 in the same manner as related-art technique, and the ceramic layer 60 interposed between both electrodes are polarized, and serve as activating portions. When the activating portions are deformed by voltages selectively supplied from the flexible flat cable 22, ejecting pressure is applied to the pressure chamber 40 of the cavity section 20.

In the cavity section 20, in order to form the complicate ink flow paths as described above on the frame portions thereof, the plurality of plates having the penetration portions and the concave portions formed thereon are laminated so as to face large-area surfaces to each others, and the plates are joined with adhesive. As shown FIGS. 3 to 5 in the first exemplary embodiment, the cavity section 20 is formed of total eight thin plates including a nozzle plate 30, a spacer plate 31, a damper plate 32, the two manifold plates 33 and 34, a supply plate 35, a base plate 36, and a cavity plate 37.

The plates 30 to 37 have thicknesses in the range of 50 to 150 μm, the nozzle plate 30 is made of synthetic resin such as polyimide, and the other plates 31 to 37 are made of 42% nickel alloy steel plate.

Figure 3:
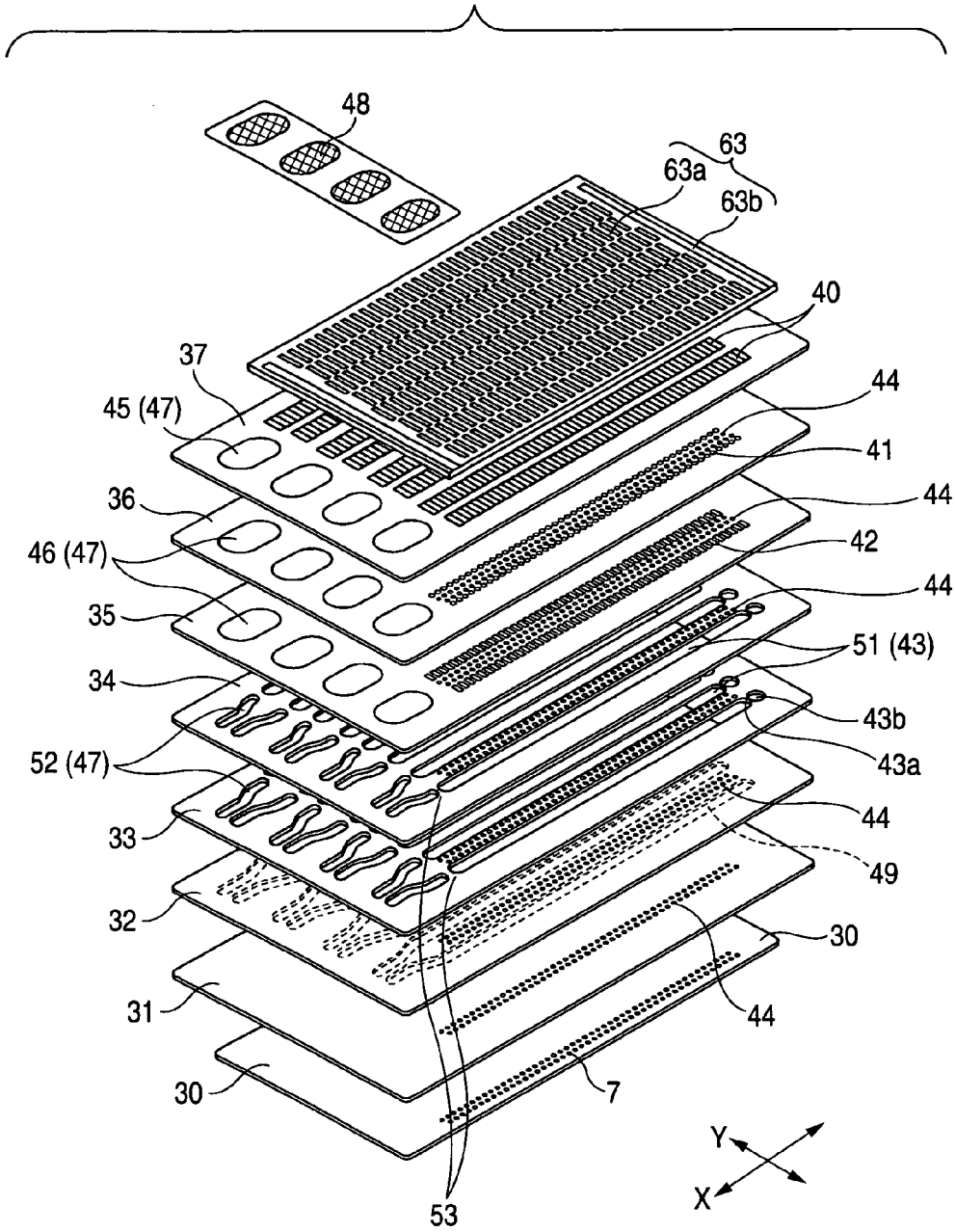
FIG. 3 is an exploded perspective view illustrating a cavity section according to the first exemplary embodiments.
Figure 4:
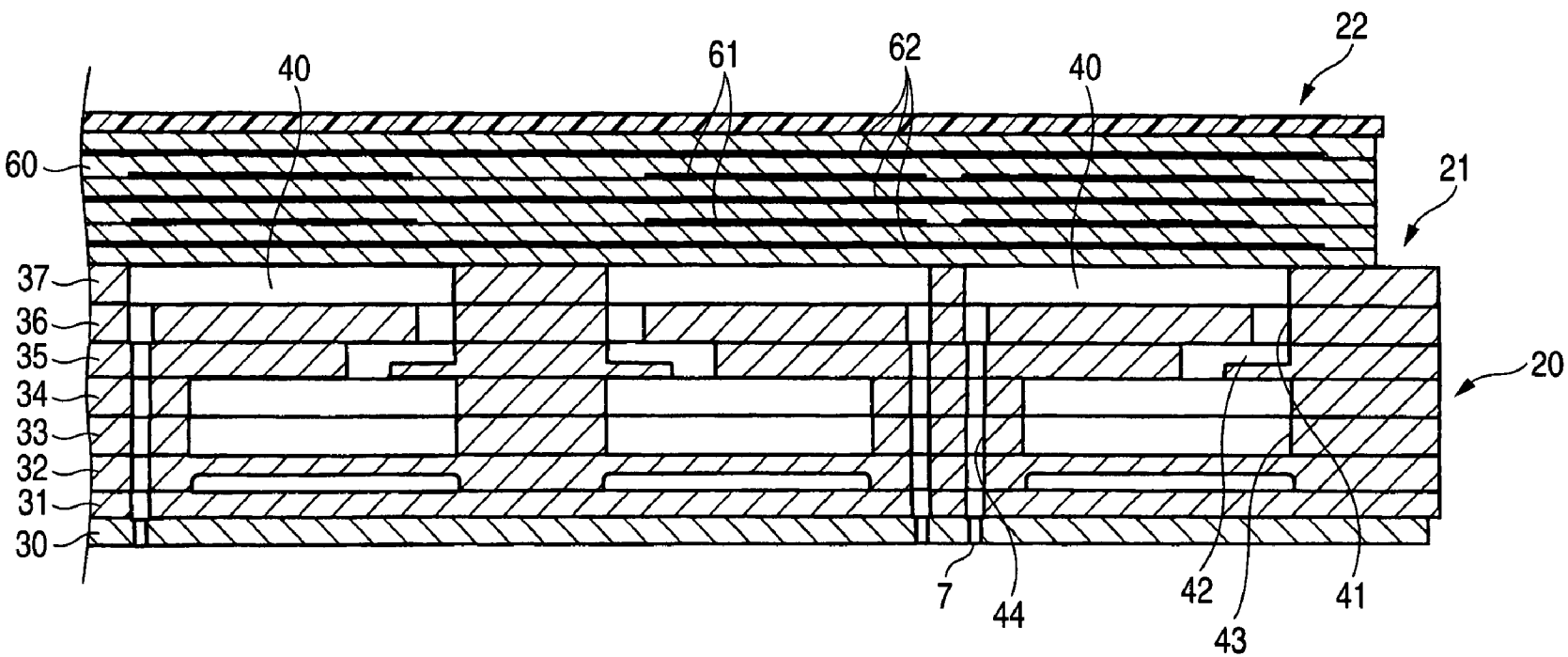
FIG. 4 is a sectional view taken along line IV-IV as viewed in the direction of arrow shown in FIG. 2.

The nozzle plate 30 includes a plurality of holes serving as the nozzles 7, which have a fine diameter (about 25 μm) and ejects ink, are arranged in a zigzag shape at a fine interval and in eight rows parallel to the X axis direction (in FIG. 3, only two rows are shown).

As shown in FIGS. 2 and 3, the cavity plate 37 includes the plurality of pressure chambers 40 arranged in eight rows parallel to the X axis direction. In the first exemplary embodiment, the pressure chambers 40 are formed in a thin and long shape in a plan view by penetrating through the cavity plate 37 in a thickness direction so that the lengthwise direction thereof is parallel to the Y axis direction.

One end of each pressure chamber 40 in the lengthwise direction is connected to each communicating hole 41 disposed in the base plate 36. The pressure chambers 40 communicate with the common ink chambers 43 through the communicating holes 41 and the connection flow paths 42 disposed on the supply plate 35. The other end of each pressure chamber 40 in the lengthwise direction (Y axis direction) communicates with each nozzle 7 in the nozzle plate 30 through a penetrating path 44 that is penetrated through the base plate 36, the supply plate 35, the two manifold plates 34 and 33, the damper plate 32, and the spacer plate 31.

The connection flow path 42 includes a narrowing portion (not shown in the drawings) in the middle thereof. The narrowing portion is formed to increase the flow resistance by decreasing sectional area thereof. When the ink in the pressure chambers 40 receives the ejecting pressure, the narrowing portion suppress backflow of the ink (pressure waves) from the pressure chamber 40 side toward the common ink chamber 43 side. With such a configuration, it is possible to efficiently send the ink to the nozzle 7 side by the ejecting pressure received from the actuator 21.

The damper plate 32 includes damper chambers 49 in the lower face side thereof adjacent to the lower face of the manifold plate 33. The damper chambers 49 is isolated from the common ink chambers 43 and formed in a concave shape so as to correspond to the shape and the position of the common ink chamber 43. The damper plate 32 is made of metal that can be elastically deformed, and thus ceiling portions formed in a thin plate shape on the upper portions of the damper chambers 49 can freely vibrate in the common ink chamber 43 side and in the damper chamber 49 side. At the time of ejecting the ink, even when pressure fluctuation that occurs in the pressure chambers 40 is transmitted to the common ink chamber 43, the ceiling portions vibrate by elastic deformation, and thus damper effect that the pressure fluctuation is absorbed and attenuated can be obtained. As a result, it is possible to suppress cross-talk that the pressure fluctuation is transmitted to other pressure chambers 40.

The cavity plate 37, which is the uppermost layer, includes four ink inlets 45 corresponding to four color inks arranged on a position closer to one side parallel to the Y axis direction. Through the ink inlets 45, the four color inks separately flow from the ink cartridges 13 into the recording head 3. The connection openings 46 are arranged to correspond to positions of the ink inlets 45 in the up and down direction, and are formed to be penetrated through the base plate 36 and the supply plate 35. A filter body 48 is attached so as to cover the ink inlets 45. The filter body 48 includes a mesh portion for removing waste in the ink.

Ink supply paths 47 are formed so as to send the ink, which is supplied form the ink cartridges 13 to the ink inlets 45, to the common ink chambers 43 by connecting those ink inlets 45 and connection openings 46 to second openings 52 formed to be penetrated through the manifold plate 33 and 34. In other words, the supply paths 47 are formed by combining the openings formed in the plurality of plates.

Each of the manifold plate 33 and 34 includes first openings 51 forming the common ink chambers 43, the second openings 52 forming the supply paths 47 and partitioning portions 53 disposed between the first openings 51 and the second openings 52, respectively. These are arranged in the X axis direction (first direction). In the first exemplary embodiment, four color inks are ejected from the eight nozzle rows arranged in the Y axis direction, and two nozzle rows adjacent to each other eject the same color ink. Hence, the eight ink chambers 43 are arranged so as to correspond to the arrangement of the nozzle rows. Each pair of common ink chambers adjacent to each other stores the same color ink.

Accordingly, in the manifold plate 33 and 34, the first openings 51 are formed as long holes along the X axis direction, and are arranged in eight rows parallel to each other in the Y axis direction. The long holes have a linear shape longer than a length of the nozzle rows. The partitioning portions 53 are located at a position departing from the end of the nozzle rows. Thus, it is possible to reduce (avoid) influence caused by the partitioning portions 53 on ejecting performance of the nozzles 7.

Each of the first openings 51 includes an auxiliary chamber 43*b* having a small inner cavity which is defined by narrow width portions 43*a* on one end side of each first opening 51 that is opposite to the other end side thereof close to each second opening 52 in the lengthwise direction (the X axis direction). The auxiliary chamber 43*b* can suppress pressure waves by flowing ink therein when the ink flows back from the pressure chamber 40 side to the common ink chamber 43 and pressure waves of the ink are transmitted in the lengthwise direction of the common ink chamber 43. With such a configuration, the crosstalk that the pressure waves of the ink are transmitted between the nozzles 7 through the common ink chambers 43 is suppressed.

The second openings 52 are arranged in parallel on the other end side (the end side opposite to the auxiliary chamber 43*a*) of the first openings 51 in the X axis direction. The second openings 52 has a smaller length than the first openings 51, but the second openings 52 are formed in a long hole shape that extends in the X axis direction while appropriately bending so as to connect the ink inlet 45 to the common ink chamber 43 in a plan view in accordance with position relationship between the ink inlet 45 and the other end of the common ink chamber 43. The second openings 52 are disposed so as to correspond to the first openings 51, and thus second openings 52 are arranged as eight rows in the Y axis direction in the same manner as the first openings 51.

Each of the partitioning portions 53 includes a partitioning portion 53*a* formed on the upper manifold plate 34 and a partitioning portion 53*b* formed on the lower manifold plate 33. The partitioning portions 53 are disposed on a position where the partitioning portions 53*a* and 53*b* do not overlap with each other (that is, those are distanced (apart) from each other in the X axis direction) in a plan view in the laminating direction. Specifically, the positions of the partitioning portions 53 are apart from each other in the upper manifold plate 34 and in the lower manifold plate 33 in the X axis direction, respectively. The partitioning portions 53*a* face to the second openings 52 of the lower manifold plate 33. The partitioning portions 53*b* face to the first openings 51 of the upper manifold plate 34.

The first openings 51 of the upper manifold plate 34 and the first openings 51 of the lower manifold plate 33 coincide with each other in a shape (an outline) thereof other than a shape (an outline) of the end portions thereof close to the partitioning portions 53 in up and down direction. The second openings 52 of the upper manifold plate 34 and the second openings 52 of the lower manifold plate 33 also coincide with each other in a shape (an outline) thereof other than a shape (an outline) of the end portions thereof close to the partitioning portions 53 in up and down direction.

The eight first openings 51 and the eight second openings 52 are arranged in the Y axis direction, and thus each of the partitioning portions 53*b* (53*a*) formed on the same manifold plate 33 (34) continuously extends in the Y axis direction. Since the partitioning portions 53 continuously extends in the Y axis direction as described above, the partitioning portions 53 are disposed on the same position relative to respective common ink chambers 43 and the supply paths 47. Hence, rigidity of the plates and flow resistance of the ink flow paths are uniformed, and thus it is possible to suppress ejecting variation in respective ink colors.

The two manifold plates 33 and 34 having the first openings 51 and the second openings 52 formed thereon are interposed between the supply plate 35 and the damper plate 32. In this case, the supply plate 35 serving as a ceiling face of the common ink chambers 43 is located on the upper side (which is close to the ink inlet) of the manifold plate 34, and the damper plate 32 serving as a bottom face of the common ink chambers 43 is located on the lower side (which is far from the ink inlet 45) of the manifold plate 33. Accordingly, eight first openings 51 are formed as eight common ink chambers 43, and eight second openings 52 are formed as a part of the supply paths 47.

As described above, the upper and lower partitioning portions 53 are located so as not to overlap with each other in a plan view, and are apart from each other toward the upstream side and the downstream side in the ink flow direction, respectively. Accordingly, the second openings 52 in one side (which is the lower side in FIG. 5) of the two manifold plates 33 and 34 communicate with the first openings 51 of the other side (which is the upper side in FIG. 5) thereof. Thus, it is possible to flow ink from the supply paths 47 to the common ink chambers 43.

The eight second openings 52 communicating with the common ink chambers 43 are formed to be penetrated through each of the manifold plates 33 and 34. However, the four ink inlets 45 and the four connection openings 46 are formed to be penetrated through each of the plates. Hence, when the ink entering from one ink inlet 45 flows along the supply paths 47 in the laminating direction of the plates and reaches the manifold plates 33 and 34, the ink flow is bent in a direction orthogonal to the laminating direction and divided into two by the second openings 52. That is, two of the eight second openings 52 are formed as one set, and in the one set, the ink having the same color flows.

Figure 5:
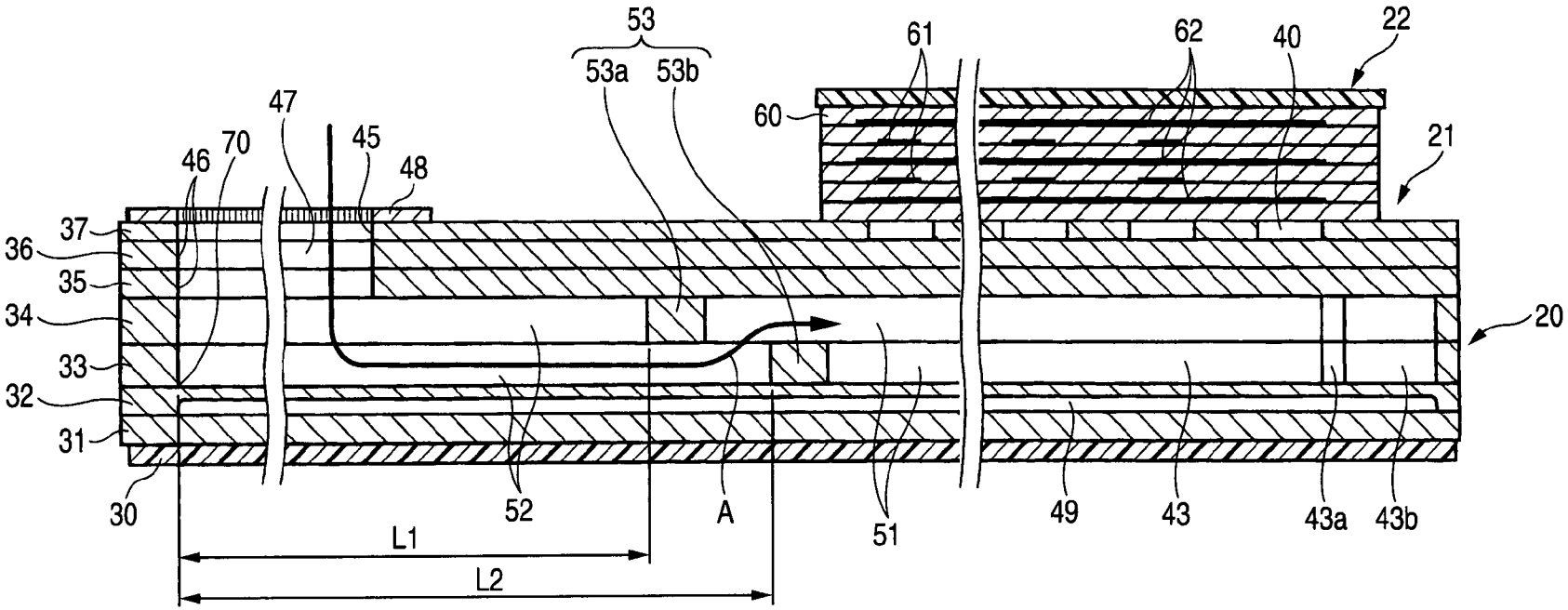
FIG. 5 is a sectional view taken along line V-V as viewed in the direction of arrow shown in FIG. 2.

The ink of which flow direction is changed in the manifold plates 33 and 34 flows along large-area surfaces of the manifold plate 33 and 34, moves in the up and down directions (the laminating direction) to pass through a gap between the partitioning portions 53*a* and 53*b* arranged apart from each others in an upstream side and a downstream side in the ink flow direction, and flows in the common ink chambers 43 (see an arrow A shown in FIG. 5).

In the related-art configuration (JP-A-2006-334797 and the like) as described above, through-holes forming the supply paths 47 and through-holes forming the common ink chambers 43 are arranged as a long hole shape on the manifold plates. The plurality of frame portions having a narrow width remains to elongate in parallel to each other in the center of the manifold plates. Therefore, when the manifold plates are lifted up, thin and long frame portions bend toward the lower side, and it is easy to cause deformation and damage.

However, in the first exemplary embodiment, the long hole is divided into the first opening portion 51 and the second opening portion 52 by providing the partitioning portion 53. Thus, it is possible to increase the frame portions (the partitioning portions) by providing the partitioning portions 53, and it is possible to increase rigidity. In addition, as might be expected, a length of the first opening portion 51 is smaller than a length of the long hole of the related-art configuration in the lengthwise direction. Thus, a length of the thin and long frame portion that remains to elongate between the first opening portions 51 adjacent to each other decreases as compared with the related-art configuration. Accordingly, the thin and long frame portions can more resist against bending at the time when the manifold plates are lifted up. In the first exemplary embodiment, such factors increase the effect that the workability (the handling ability) at the time of handling the manifold plates 33 and 34 improves. As a result, in a manufacturing process, it is possible to prevent the manifold plate 33 and 34 from being damaged and deformed, and thus it is possible to increase manufacturing efficiency.

In addition, in the exemplary embodiment, the common ink chamber 43 is not formed of one plate, and is formed of at least two (herein, two plates are employed) manifold plates. Accordingly, by employing the upper and lower manifold plate 34 and 33, the partitioning portions 53 are located apart from each other in the upstream side and downstream side in the ink flow direction, respectively. With such a configuration, even when the partitioning portions 53 are disposed, it is possible to continuously flow sufficient ink into the common ink chambers 43 by connecting the supply paths 47 to the common ink chambers 43.

In addition, in a length of a part where ink flows in parallel to a large-area surface of the plates in the second openings 52 as shown in FIG. 5, it is advantageous that a length L1 of the second openings 52 of the upper side (which is close to the ink inlets 45) would be smaller than a length L2 of the second openings 52 of the lower side (which is far form the ink inlets 45) (L1<L2).

Figure 6:
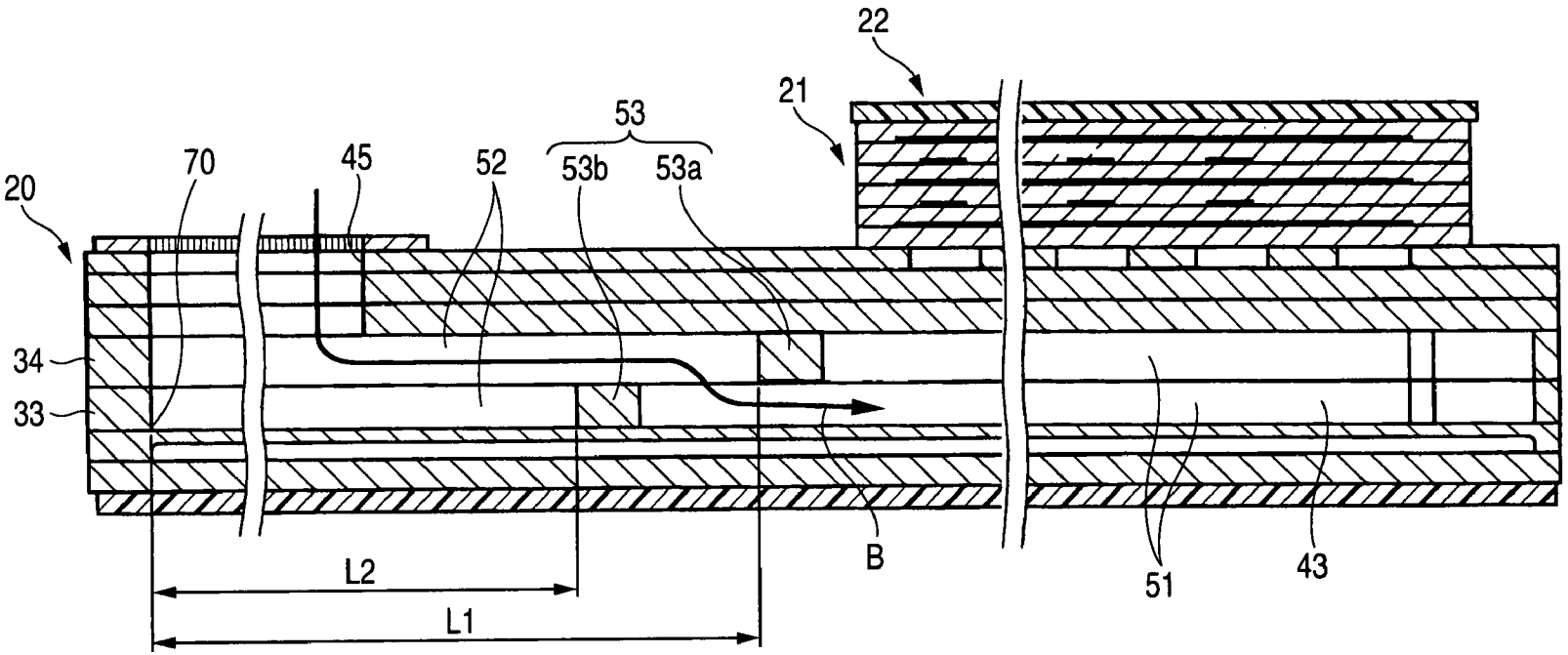
FIG. 6 is a sectional view corresponding to FIG. 5 in a comparative example.

The lengths L1 and L2 of the second opening are determined by a position of the partitioning portion 53. As shown in FIG. 6, when L1 is lager than L2 (L1>L2), the partitioning portion 53*b* of the lower side is disposed on a position closer to a corner 70 than the partitioning portion 53*a* of the upper side. The corner 70 is a location where ink flow direction is changed from the laminating direction to a direction orthogonal thereto. The ink flows in the common ink chamber 43 while avoiding the partitioning portions 53, and thus, in the case of FIG. 6, the ink is likely to pass through the upper manifold plate 34 side (see an arrow B shown in FIG. 6), so that the stagnation of the ink easily occurs in the vicinity of the corner 70. Bubble also easily occurs in the stagnation, and so becomes a factor of an ejecting error.

However, when L1<L2 according to the first exemplary embodiment, ink is likely to pass through the lower manifold plate 34 side at the time of changing the ink flow direction into a direction orthogonal to the laminating direction (see the arrow A shown in FIG. 5). Therefore, it is possible to suppress an occurrence of stagnation in the corner 70.

In addition, in FIG. 3, the eight first opening portions 51 have the same shape, respectively, two of the eight second opening portions 52 formed as one set have a symmetrical shape, and four sets thereof have the same size. However, the shapes of the first opening portions 51 and the second opening portions 52 are not limited to this configuration, and it is possible to appropriately modify the shapes in accordance with the corresponding ink colors or position relationship between the ink inlets 45 and the common ink chambers 43. For example, the first and second opening portions 51 and 52 for black ink may be formed to have a larger width than the first and second openings for the other color inks, and it is also allowed to increase inner capacity of those. In addition, one set of the second openings 52 may be formed in an asymmetrical shape, but in this case, it is advantageous that the flow resistance in one set of the second openings 52 is set to be the same as before, as will be described later.

In addition, the supply paths 47 are formed by laminating a plurality of plates even though diameters of the flow paths are relatively large, and the one supply path 47 branches into two paths in the middle thereof, that is, in the downstream side from the location of the second opening portions 52. Even when the supply path 47 for the same color ink branches into two paths, it is advantageous to determine a shape of the second opening portions 52 so that the two branched paths have the same flow resistance. A part in the range from the common ink chambers 43 to the nozzles 7 is designed to have the same flow resistance for all nozzles 7. With such a configuration, it is possible to make ejecting characteristics of the two nozzle rows that eject the same color ink coincide with each other.

Moreover, it is advantageous that the supply paths 47 corresponding to yellow ink, magenta ink, and cyan ink should have the same flow resistance. When the flow resistance is not the same, variation occurs in progression rate of absorption purge performed on the recording head 3 mentioned above.

For example, the absorption purge is performed on the nozzle rows of black ink, yellow ink, magenta ink, and cyan ink, respectively. In this case, in the recovery unit 17 as described in, for example, JP-A-2006-272894, a cap 18 covering the nozzle surfaces includes a ring shaped rib that contacts with the nozzle surface by covering the entire nozzle rows, a division rib that divides an inside of the ring shaped rib into nozzle rows for black ink and nozzle rows for the other color inks, and an outlet that discharges the suctioned ink and is formed in each of two division chambers divided by the division rib. The outlets include discharging tubes, and communicate with the pressurizing unit (such as a suctioning pump) not shown in the drawings through a switch valve (not shown in the drawings). When the absorption purge is performed, the switch valve is changed by covering the nozzle surfaces with the cap 18, the insides of the division chambers is selectively forced to be pressurized, ink is suctioned from the nozzles, and thus bubbles and deteriorated ink are removed from the ink flow paths in the head. At this time, to prevent color mixing, the absorption purge is separately performed on the black ink and the color ink by the switch valve, and among the color inks are simultaneously suctioned. Hence, in the ink flow paths inside the head of three color inks, variation is caused in progress state of the absorption purge by color when the flow resistance is not the same for all paths. Hence, even in the manifold plates, it is advantageous that the ink flow paths in the cavity section 20 in addition to the supply paths 47 have the same flow resistance among the color inks.

Second Exemplary Embodiment

Next, a second embodiment in which the cavity section 20 according to the first exemplary embodiment is modified will be described with reference to FIG. 7. When the same elements as the first exemplary embodiment exist, those elements will be referenced by the same reference numerals and signs, and the detailed description thereof will be omitted.

Figure 7:
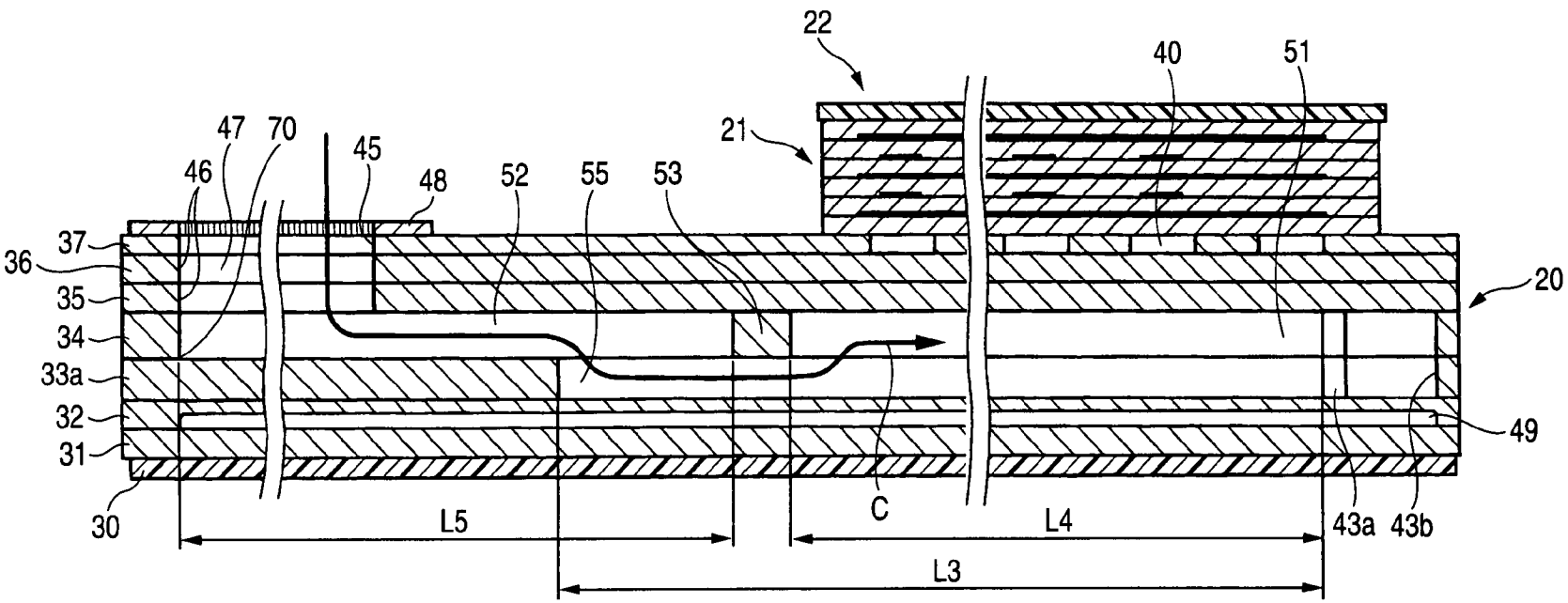
FIG. 7 is a sectional view illustrating a second exemplary embodiment.

In the cavity section 20 shown in FIG. 7, the common ink chambers 43 are formed in the range from a first manifold plate 34 to a second manifold plate 33*a*. The first manifold plate 34 has the same as the manifold plate 34 of the first exemplary embodiment, the first openings 51 forming the common ink chambers 43 elongate in the X axis direction so as to correspond to the nozzle rows, and eight first openings are arranged in the Y axis direction. The second openings 52 are also disposed adjacent to the first openings 51 in the X axis direction with the partitioning portions 53 disposed therebetween.

In the second manifold plate 33*a* adjacent to the lower face of the first manifold plate 34, third openings 55 extending in the X axis direction, and eight third openings 55 are arranged in the Y axis direction. The third openings 55 overlaps with the first opening 51 and the second openings 52 of the first manifold plate 34 in a plan view, and are disposed in the range from the first opening 51 and the second openings 52 with the partitioning portions 53 disposed therebetween. A length L3 of the third openings 55 in the X axis direction is shorter than sum of a length L4 of the first openings 51 in the X axis direction and a length L5 of the second openings 52 in the X axis direction, and the length L3 of the third openings 55 is longer than the length L4 of the first openings 51. In addition, in the first openings 51 and the third openings 55, shapes (outlines) of the ends opposite to the second opening 52 side coincide with each other in the up and down directions.

As described above, the first manifold plate 34 and the second manifold plate 33*a* overlap with each other, and the supply plate 35 and the damper plate 32 are laminated so as to sandwich them. In this case, the common ink chambers 43 are formed of the first openings 51 and the third openings 55, and the supply paths 47 are also formed. At this time, the lower face of the partitioning portion 53 faces the third opening 55. Therefore, a side close to the second opening 52 in the third opening 55 communicates with the second opening 52. Accordingly, the ink flowing from the supply path 47 flows from the second opening 52 into the third opening 55 so as to avoid the partitioning portion 53, and directly flows in the common ink chamber 43 (see an arrow C shown in FIG. 7).

In the second exemplary embodiment, there are not provided openings having the same (overlapping) shape as the second openings 52 on the second manifold plate 33*a*. Thus, when the ink flowing through the supply path 47 reaches the manifold plate 34, flow of the ink slightly bends in a direction orthogonal to the laminating direction of the plates. Thus, there is an advantage that stagnation in the corner 70 decreases. In the second exemplary embodiment, the supply paths 47 are set to have the same flow resistance for the ink flow for supplying the same color.

In the case of the second exemplary embodiment, the third openings 55 are formed to be penetrated through the second manifold plate 33*a*. However, the length of the third opening 55 is shorter than sum of the length of the first opening 51 and the length of the second opening 52, and thus the cut-out portions (the void portions) decreases. Therefore, it is possible to increase the rigidity even when the partitioning portions are not provided.

Third Exemplary Embodiment

Next, a third exemplary embodiment in which the cavity section 20 according to the first exemplary embodiment is modified will be described with reference to FIGS. 8, 9A and 9B. When the same elements as the first exemplary embodiment exist, those elements will be referenced by the same reference numerals and sings, and the detailed description thereof will be omitted.

Figure 8:
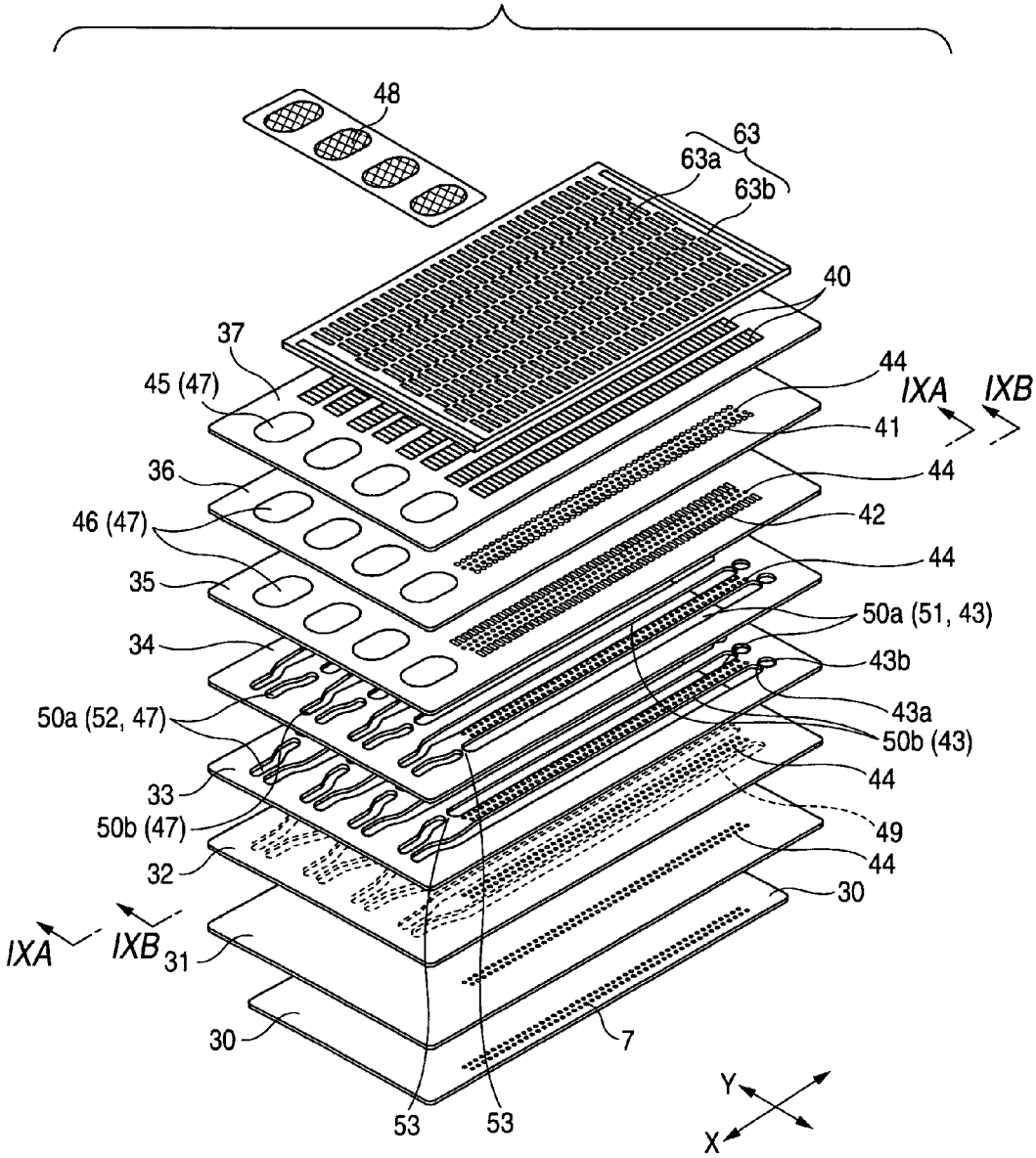
FIG. 8 is an exploded perspective view illustrating a cavity section according to a third exemplary embodiment.
Figure 9A:
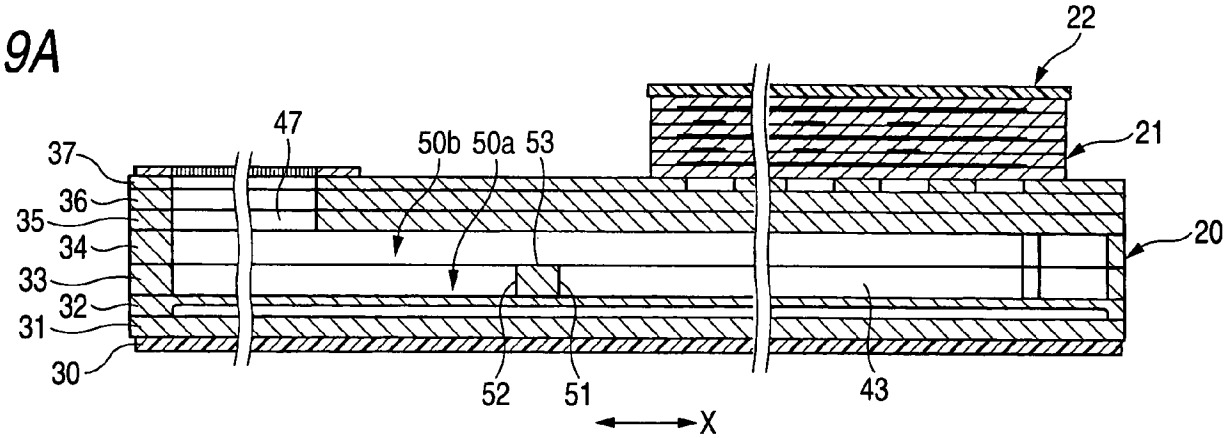
FIG. 9A is a sectional view taken along line IXA-IXA as viewed in the direction of arrow shown in FIG. 8.
Figure 9B:
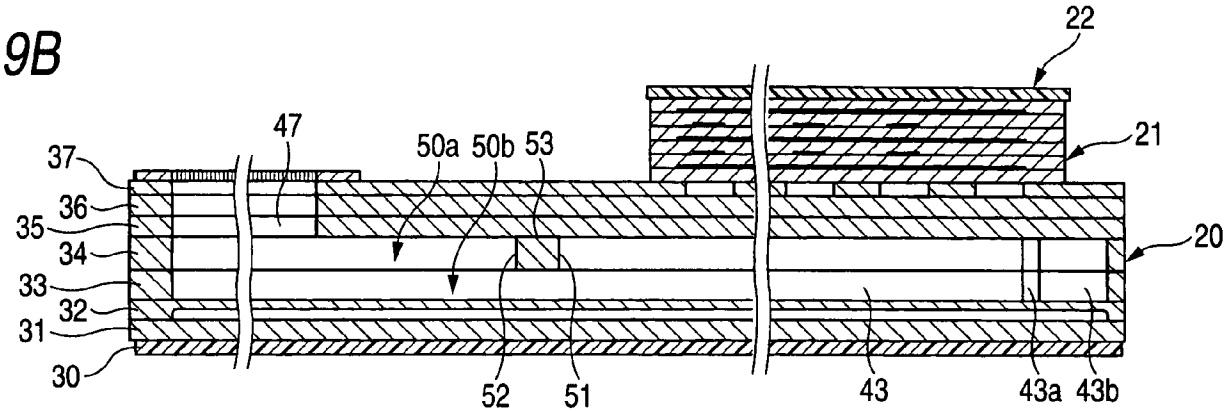
FIG. 9B is a sectional view taken along line IXB-IXB as viewed in the direction of arrow shown in FIG. 8.

As shown in FIG. 8, each of the manifold plate 33 and 34 of the cavity section 20 is formed with eight openings penetrating therethrough similarly to the first exemplary embodiment. However, the eight openings include openings 50*a* and openings 50*b*. Each of the openings 50*a* includes a first opening 51, a second opening 52 and a partitioning portion 53 disposed between the first opening 51 and the second opening 52. On the other hand, the opening 50*b* is not provided with a partitioning portion and formed as continuous long hole. That is, in the opening 50*a*, the first opening 51 forming the common ink chamber 43 and the second opening 52 forming the supply path 47 is arranged in one plate with a partitioning portion 53 disposed therebetween. On the other hand, in the opening 50*b*, a part forming the common ink chamber 43 and a part forming the supply path 47 are formed continuously in one plate.

In each of the manifold plate 33 and 34, the opening 50*a* and the opening 50*b* are arranged alternately in the Y axis direction. Therefore, in each of the manifold plate 33 and 34, four partitioning portion 53 are arranged in the Y axis direction with an interval therebetween. The opening 50*a* and opening 50*b* is formed to have almost same shape except for the partitioning portion 53.

It is noted that the arrangement order of the opening 50*a* with the partitioning portion 53 and the opening 50*b* without the partitioning portion 53 are different between the upper manifold plate 34 and the lower manifold plate 33. Specifically, the opening 50*a* with the partitioning portion 53 in the upper manifold plate 34 overlaps with the opening 50*b* without the partitioning portion 53 in the lower manifold plate 33. The opening 50*b* without the partitioning portion 53 in the upper manifold plate 34 overlaps with the opening 50*a* with the portioning portion 53 in the lower manifold plate 33.

Accordingly, the first opening 51 in the opening 50*a* overlaps with the opening 50*b* at lower or upper side to form the common ink chamber 43. The second opening 52 in the opening 50*a* overlaps with the opening 50*b* at lower or upper side to form the supply path 47.

According to the configuration described above, as shown in FIGS. 9A and 9B, although the first opening 51 forming the common ink chamber 43 in one of the manifold plates 33 and 34 is separated from the second opening 52 forming the supply path 47 in the same plate by the partitioning portion 53, the first opening 51 and the second opening 52 communicate with the part forming the common ink chamber 43 and the part forming the supply path in the other one of the manifold plates 33 and 34 at upper or lower side. Therefore, ink from the ink inlets 45 flows in the supply path 47 formed by the second opening 52 and the part of the opening 50*b* and the opening 50*b* while avoiding the partitioning portion 53 to enter into the common ink chamber 43 formed by the first opening 51 and the opening 50*b*.

As described above, when the manifold plates 33 and 34 are laminated, the partitioning portion 53 in the upper manifold plate 34 and the partitioning portion 53 in the lower manifold plate 33 are arranged on a row extending in the Y axis direction as viewed in the laminating direction. However, the position of the partitioning portion 53 is not limited thereto. The partitioning portions 53 may be displaced in the X axis direction with each other when viewed in the laminating direction. Additionally, in accordance with the configuration of the common ink chamber 43 and the supply path 47, two (or three or more) of the openings 50*a* and openings 50*b* may be arranged alternately not arranged alternately one by one.

According to the third exemplary embodiment, cut-out portions (void portions) penetrating through the manifold plates increases by the number of the partitioning portion 53, compared with the case where the partitioning portion 53 is provided with all the opening 50 according to the first exemplary embodiment. However, since the openings 50*a* and the openings 50 are arranged alternately, the frame portions extending (remaining) in the X axis direction between the openings can be reinforced by the partitioning portion 53 disposed alternately in the Y axis direction. Therefore, this configuration has an advantage in improving rigidity. Then, it may be possible to prevent the manifold plate 33 and 34 from being damaged and deformed when handling the plates themselves.

Additionally, in the first exemplary embodiment, when ink flows from the supply path 47 into the common ink chamber 43, the ink flows in the laminating direction between the partitioning portions 53*a* and 53*b*. However, in the third exemplary embodiment, the ink flows from the supply path 47 into the common ink chamber 43 while avoiding only one partitioning portion 53 disposed in lower or upper manifold plate. Therefore, in the third exemplary embodiment, the number of partitioning portion 53 to be avoided is smaller, that is, obstacles for ink to flow from the supply path 47 into the common ink chamber 43 becomes less. Then, flow resistance for ink can be decreased.

The configuration (the number and type) of plates of the cavity section 20 according to the first to third exemplary embodiments is an example, and does not limit the invention. In the exemplary embodiments, the common ink chamber is formed of two plates, but it is also allowed to employ three plates or more. In addition, when the common ink chamber is formed of a plurality of plates, the first openings 51 of a plate of the uppermost layer (the ceiling face side of the common ink chamber) or a plate of the lowermost layer (the bottom face side of the common ink chamber) may be formed in a concave shape (a half etching). In this case, the concave face is configured to be formed as the inner face of the common ink chamber 43. In addition, in the plate of the lowermost layer, the second openings 52 may be formed in a concave shape (the half etching).

In the exemplary embodiments, the lower part of the common ink chambers 43 is formed by adjoining the damper plate 32 to the lower side of the lower manifold plate 33 where the first openings 51 are formed, but it is also allowed to employ a plate having different functions. For example, when the damper chambers 49 are not provided, the spacer plate 31 is adjacent to the lower side of the manifold plate 33. In this case, in the lower manifold plates 33 and 33*a*, the damper effect can be obtained by forming the lower part of the common ink chambers 43 in a concave shape (the half etching) as described above.

In addition, in the exemplary embodiments, one supply path 47 corresponds to two common ink chambers 43 that store ink having the same color, branches into two paths in the middle of the supply path 47, and connected to the two common ink chambers. However, it is also allowed to independently connect the supply paths 47 to the common ink chambers 43, respectively, or connect one supply path 47 to three or more common ink chambers 43. Another partitioning portion may be provided in the first opening 51.

Moreover, the liquid drop ejecting device of the invention is not limited to the recording apparatus 1 according to the exemplary embodiments, and it is also allowed to apply to a device that ejects liquid other than ink.

According to exemplary embodiments of the present invention, the first openings are formed as the common liquid chamber and second openings are formed as the supply path with partitioning portions disposed between the first openings and the second openings that are formed in a through-hole shape or a concave shape, on a manifold plate. Generally, in the related-art manifold plate, there has been provided a long hole that connects the first openings to the second openings without the partitioning portions. As compared with this, a length of the long hole formed on the manifold plate is divided into a length of the common liquid chamber and a length of the supply path by providing the partitioning portions. Thus, it is possible to increase the frame portions (the partitioning portions) by reducing the cut-out portion (void portions) of the manifold plate. As a result, it is possible to highly increase rigidity of the manifold plates, and workability improves at the time of handling the manifold plate in a manufacturing process, so that it is possible to prevent the manifold plates from being damaged and deformed.

According to exemplary embodiments of the present invention, the liquid drop ejecting head includes at least two manifold plates, and the partitioning portions of the manifold plates are arranged apart from a position where the partitioning portions overlap with each other in a plan view. Thus, the first openings communicate with the second openings throughout the plurality of manifold plates, so that liquid flows from the supply paths into the common liquid chamber through a gap between the partitioning portions in the laminating direction. That is, in one manifold plate, even when the openings formed as the common liquid chambers are discontinuously arranged by being divided into the first openings and second openings by partitioning portions, positions of the partitioning portions are arranged apart from each others toward an upstream side and a downstream side in a flow direction by providing a plurality of manifold plates. With such a configuration, even when the partitioning portions are continuously arranged in the supply paths formed of the second openings and the common liquid chambers formed of the first openings, it is possible to promptly flow ink from the supply paths into the common liquid chambers.

According to exemplary embodiments of the present invention, the first openings and second openings are formed to be penetrated through the manifold plates, and the common liquid chamber and the supply paths are formed of at least two manifold plates and plates that sandwich upper side and lower side of the two manifold plates. With such a configuration, in the common liquid chamber, it is possible to secure a height thereof equal to a total thickness of the manifold plates, and thus it is possible to increase an inner capacity thereof. In this case, since parts penetrated through the manifold plates, that is, the cut-out portions (the void portions) increase, the rigidity of the manifold plates easily decreases. However, the partitioning portions are provided, and thus it is possible to suppress the decrease in rigidity of the manifold plates.

According to exemplary embodiments of the present invention, the common liquid chambers are formed to elongate in the first direction, and the plurality of the common liquid chambers are arranged in parallel to each others in a second direction. Hence, the number of the first openings increases as many as the number of the common liquid chambers, and rigidity of the entire manifold plates depends on only the frame portions having a narrow width between the plurality of first openings adjacent to each other. However, the partitioning portions are provided as described above, and thus it is possible to suppress the increase in area of the cut-out portions (the void portions) in the manifold plates. As a result, it is possible to increase rigidity of the manifold plates.

According to exemplary embodiments of the present invention, the second openings disposed on the manifold plate of the lower side in the second openings forming the supply paths are set so as to have a larger length in the first direction than the second openings disposed on the manifold plate of the upper side. In this case, when liquid flows from the liquid supply source in a laminating direction and reaches the manifold plate, flow direction is changed to a direction substantially orthogonal to the laminating direction, and the liquid flows in the first direction along a lengthwise surface of the manifold plate. Each length of the second openings in the first direction depends on each position of the partitioning portions. Accordingly, the partitioning portions of the upper manifold plate close to the liquid supply source are disposed on positions closer to corners of the supply paths than the partitioning portions of the lower manifold plate far from the liquid supply source. The corner is a position where flow direction of liquid is changed to a direction substantially orthogonal thereto.

Hence, the liquid flows in the laminating direction, and flow direction thereof is changed to a direction substantially orthogonal thereto. Then, the liquid flows through a side far from the liquid supply source so as to avoid the partitioning portion disposed on a side close to the corner. Generally, stagnation of liquid easily occurs at the corner, and the stagnation causes problems such as bubble stagnation. However, when the liquid flows through the side far from the liquid supply source and the flow path bends at a right angle, it is possible to obtain an advantage that the stagnation hardly occurs at the corner.

According to exemplary embodiments of the present invention, in the first manifold plate, the first openings and the second openings are formed as the common liquid chamber and the supply path, respectively, with partitioning portions disposed therebetween. In the second manifold plate of the lower side, the third openings overlap with the first and the second openings, and thus, it is possible to communicate the first openings with the second openings in the first manifold plate through the third openings. The first manifold plate has the partitioning portions, and in the second manifold plate a length of the third openings is smaller than sum of the lengths of the first openings and the second openings. Thus, it is possible to increase rigidity of the manifold plates, and workability improves in a manufacturing process, so that it is possible to prevent the manifold plates from being damaged and deformed.

According to exemplary embodiments of the present invention, the first openings and the second openings are formed in the through-hole shape so as to be penetrated through the first manifold plate, and the common liquid chamber and the supply path are formed of at least one first manifold plate, a plate positioned on an upper side of the first manifold plate, and the second manifold plate. With such a configuration, in the common liquid chamber, it is possible to secure a height thereof equal to total thickness of the first manifold plates and total depth of the third openings, and thus it is possible to increase an inner capacity thereof. In this case, since parts penetrated through the first manifold plate, that is, the cut-out portions (the void portions) increase, the rigidity of the first manifold plate easily decreases. However, the partitioning portions are provided as described above, and thus it is possible to suppress the decrease in rigidity of the manifold plates.

According to exemplary embodiment of the present invention, the common liquid chambers are formed to elongate in the first direction, and the plurality of the common liquid chambers are arranged in parallel to each others in a second direction. Hence, the number of the first openings increases as many as the number of the common liquid chambers, and rigidity of the entire manifold plates depends on only the frame portions having a narrow width between the plurality of first openings adjacent to each other. However, the partitioning portions are provided as described above, and thus it is possible to suppress the increase in area of the cut-out portions (the void portions) in the first manifold plate. As a result, it is possible to increase rigidity of the manifold plates.

According to exemplary embodiments of the present invention, the supply paths communicating with the common liquid chambers collecting the ink of the same color are set so as to have substantially the same flow resistance. The supply path has a relatively large flow-path diameter, but the supply path is formed by laminating a plurality of plates. Thus, variation in flow resistance easily occurs. Hence, the flow resistance is maintained at a constant level as a whole, and thus, it is possible to suppress variation in ejection characteristics of the rows of the nozzles for ejecting the same color ink.

What is claimed is:

1. A liquid drop ejecting head comprising:

a cavity section including:

a plurality of nozzles which are arranged in a row extending in a first direction and eject liquid drops;

a common liquid chamber which distributes liquid to the nozzles; and a supply path which communicates with the common liquid chamber and supplies liquid from a liquid supply source to the common liquid chamber, wherein the cavity section is formed by laminating a plurality of plates including at least first and second manifold plates adjacent to each other in a laminating direction, each of the first and second manifold plates including an opening, wherein the openings of the first and second manifold plates overlap with each other when viewed in the laminating direction, wherein at least one of the openings includes:

a first opening which extends in the first direction and serves as the common liquid chamber;

a second opening which is adjacent to the first opening and serves as the supply path; and a partitioning portion disposed between the first opening and the second opening.

2. The liquid drop ejecting head according to claim 1, wherein each of the openings includes the first opening, the second opening and the partitioning portion disposed between the first opening and the second opening, and wherein the partitioning portion of the first manifold plate is positioned so as not to overlap with the partitioning portion of the second manifold plate when viewed in the laminating direction.

3. The liquid drop ejecting head according to claim 2, wherein the first openings and the second openings of the first and second manifold plates are formed into a hole penetrating therethrough or a concave provided thereon.

4. The liquid drop ejecting head according to claim 2, wherein the first openings and the second openings of the first and second manifold plates are formed into a hole penetrating therethrough, wherein the plurality of plates which forms the cavity section further includes:

an upper plate which is laminated on the first manifold plate and includes a connection opening communicating with the second openings; and a bottom plate which is laminated below the second manifold plate and covers the first openings and the second openings, and wherein the common ink chamber and the supply path is formed by laminating the upper plate, the first and second manifold plates and the bottom plate.

5. The liquid drop ejecting head according to claim 2, wherein the plurality of nozzles are arranged in a plurality of rows extending in the first direction, the plurality of rows being arranged in a second direction intersecting with the first direction, wherein each of the first and second manifold plates includes:

a plurality of first openings provided so as to correspond to the plurality of rows;

a plurality of second openings provided so as to correspond to the plurality of first openings; and a plurality of partitioning portions disposed between each of the first openings and corresponding second opening, and wherein the plurality of partitioning portions of each of the first and second manifold plates are formed to continuously extend in the second direction.

6. The liquid drop ejecting head according to claim 2, wherein the first manifold plate is laminated on the second manifold plate so that the first manifold plate is arranged upstream from the liquid supply source in the supply path, wherein a length of the second opening of the second manifold plate is larger than a length of the second opening of the first manifold plate, and wherein the second opening of the second manifold plate communicates with the first opening of the first manifold plate.

7. The liquid drop ejecting head according to claim 1, wherein the liquid includes a black ink and a plurality of color inks, wherein the plurality of nozzles are arranged in a plurality of rows for respective ink colors, wherein the cavity section includes a plurality of common liquid chamber so as to correspond to the plurality of rows for respective colors and a plurality of supply paths which communicate respective common liquid chambers, and wherein the supply paths which communicate with the common liquid chambers for a same color ink have substantially same flow resistance.

8. The liquid drop ejecting head according to claim 1,
wherein the one of the overlapped openings is divided into the first opening serving as the common liquid chamber and the second opening serving as the supply path by the partitioning portion, and
wherein the other of the overlapped openings includes a part serving as the common liquid chamber and a part serving as the supply path which are continued with each other.

9. The liquid drop ejecting head according to claim 8,
wherein the plurality of nozzles are arranged in a plurality of rows extending in the first direction, the plurality of rows being arranged in a second direction intersecting with the first direction,
wherein each of the first and second manifold plates includes a plurality of openings provided so as to correspond to the plurality of rows,
wherein the plurality of openings of each of the first and second manifold plates include:
a fourth opening which includes a first opening, a second opening and a partitioning portion disposed between the first opening and the second opening; and
a fifth opening which is not provided with a partitioning portion, and
wherein the first and second manifold plates are laminated so that the fourth opening overlaps with the fifth opening when viewed in the laminating direction.

10. The liquid drop ejecting head according to claim 9,
wherein the forth opening and the fifth opening are arranged alternately in each of the first and second manifold plates.

11. A liquid drop ejecting head comprising:
a cavity section including:
a plurality of nozzles which are arranged in a row extending in a first direction and eject liquid drops;
a common liquid chamber which distributes liquid to the nozzles; and
a supply path which communicates with the common liquid chamber and supplies liquid from a liquid supply source to the common liquid chamber,
wherein the cavity section is formed by laminating a plurality of plates including at least first and second manifold plates adjacent to each other in a laminating direction,
wherein the first manifold plate includes:
a first opening which extends in the first direction and serves as the common liquid chamber;
a second opening which is adjacent to the first opening and serves as the supply path; and
a partitioning portion disposed between the first opening and the second opening, and
wherein the second manifold plate includes a third opening which overlaps with the first and second openings of the first manifold plate when viewed in the laminating direction and which has a length shorter than a sum of lengths of the first and second opening of the first manifold plate in the first direction.

12. The liquid drop ejecting head according to claim 11,
wherein the first openings and the second openings of the first and second manifold plates are formed into a hole penetrating therethrough or a concave provided thereon.

13. The liquid drop ejecting head according to claim 11,
wherein the first opening and the second opening of the first manifold plate are formed into a hole penetrating therethrough,
wherein the plurality of plates which forms the cavity section further includes an upper plate which is laminated on the first manifold plate and includes a connection opening communicating with the second opening, and
wherein the common ink chamber and the supply path is formed by laminating the upper plate, and the first and second manifold plates.

14. The liquid drop ejecting head according to claim 11,
wherein the plurality of nozzles are arranged in a plurality of rows extending in the first direction, the plurality of rows being arranged in a second direction intersecting with the first direction,
wherein the first manifold plate includes:
a plurality of first openings provided so as to correspond to the plurality of rows arranged in the second direction;
a plurality of second openings provided so as to correspond to the plurality of first openings arranged in the second direction; and
a plurality of partitioning portions disposed between each of the first openings and corresponding second opening, and
wherein the plurality of partitioning portions of the first manifold plate are formed to continuously extend in the second direction.

15. The liquid drop ejecting head according to claim 11,
wherein the liquid includes a black ink and a plurality of color inks,
wherein the plurality of nozzles are arranged in a plurality of rows for respective ink colors,
wherein the cavity section includes a plurality of common liquid chamber so as to correspond to the plurality of rows for respective colors and a plurality of supply paths which communicate respective common liquid chambers, and
wherein the supply paths which communicate with the common liquid chambers for a same color ink have substantially same flow resistance.

16. An inkjet head comprising:
a plurality of plates, each including a plurality of holes to form a plurality of nozzles arranged in a row extending in a first direction, a common ink chamber and a ink supply path which supplies ink to the common ink chamber,
wherein the plurality of plates includes first and second manifold plates adjacent to each other in a laminating direction,
wherein each of the first and second manifold plates includes an opening,
wherein one of the first and second manifold plates includes:
a first opening which extends in the first direction and serves as the common ink chamber;
a second opening which serves as the supply path; and
a partitioning portion disposed between the first opening and the second opening.

17. The inkjet head according to claim 16,
wherein the other one of the first and second manifold plates includes:
a first opening which extends in the first direction and serves as the common ink chamber;
a second opening which serves as the supply path; and
a partitioning portion disposed between the first opening and the second opening, and
wherein the partitioning portion of the first manifold plate is positioned apart from the partitioning portion of the second manifold plate when viewed in the laminating direction.

* * * * *